US005113632A

United States Patent [19]

Hanson

[11] Patent Number: 5,113,632

[45] Date of Patent: May 19, 1992

[54] SOLID WOOD PANELING SYSTEM

[75] Inventor: Ronald A. Hanson, Eveleth, Minn.

[73] Assignee: Woodline Manufacturing, Inc., Eveleth, Minn.

[21] Appl. No.: 610,850

[22] Filed: Nov. 7, 1990

[51] Int. Cl.[5] ..... E04B 2/00

[52] U.S. Cl. ..... 52/385; 403/364; 52/483

[58] Field of Search ..... 52/314, 519, 385, 536, 52/538, 483; 403/364

[56] References Cited

U.S. PATENT DOCUMENTS

| | | | |
|---|---|---|---|
| 3,204,300 | 9/1965 | Hofmann | 403/364 |
| 3,888,061 | 6/1975 | Kahr . | |
| 4,266,382 | 5/1981 | Tellman . | |
| 4,294,647 | 10/1981 | Strickler . | |
| 4,404,781 | 9/1983 | Couture et al. . | |
| 4,468,909 | 9/1984 | Eaton . | |
| 4,499,701 | 2/1985 | Bockwinkel . | |
| 4,624,295 | 11/1986 | Howland . | |
| 4,833,855 | 5/1989 | Winter, IV . | |
| 4,870,797 | 10/1989 | Hagemeyer . | |

FOREIGN PATENT DOCUMENTS

| | | | |
|---|---|---|---|
| 1535236 | 8/1967 | France | 52/483 |

*Primary Examiner*—David A. Scherbel
*Assistant Examiner*—Wynn Wood
*Attorney, Agent, or Firm*—Fredrikson & Byron

[57] ABSTRACT

The present invention provides solid wood paneling formed of beveled, solid wood planks having a uniform, standardized length. At least some of these planks are made up of shorter, random length boards that have been joined into longer, uniform length planks. All four edges of each of these individual boards are beveled so that when they are assembled into a plank, the plank will include a bevel which accentuates the location of the joint between the individual boards of a plank. Such a solid wood paneling is less expensive and easier to install than standard solid wood paneling, yet achieves the same distinctive look of standard paneling with a plurality of random length individual boards which are individually applied.

6 Claims, 2 Drawing Sheets

SOLID WOOD PANELING SYSTEM

FIELD OF THE INVENTION

The present invention relates to wood planking or paneling for walls, floors, and the like and a method for making the same.

BACKGROUND OF THE INVENTION

The appearance of solid hardwood as a flooring material or plank-style paneling for interior walls of a room has long been popular. In manufacturing such flooring or paneling, large pieces of raw lumber (logs or rough cut boards from logs) are cut into a plurality of planks of the desired nominal width and thickness. Any knots or other blemishes which are present in the raw lumber can be seen on these individual cut boards.

For decorative purposes such as flooring and paneling, however, such blemishes are undesirable because they detract from the appearance and structural integrity of the wood. To eliminate these blemishes, the portions of these planks which include visible knots and the like are cut out and discarded or used for other, less aesthetically demanding purposes. Thus, the resulting product includes planks of random lengths, depending on the size and quality of the original, raw lumber.

When the blemished wood is cut out of the long planks, the ends of the planks are commonly cut such that they will mate with the end of an adjacent plank when installed. This mating end construction may be of the tongue and groove type described in more detail below.

These random length planks of rough-hewn lumber are then usually subjected to further manufacturing steps, such as planing or jointing, sanding and sometimes finishing (such as with stains and/or varnishes or other protective coatings), to yield the desired appearance. Because of this highly selective process for producing planks without knots or other blemishes, such solid hardwood planks are both highly desired and tend to be relatively expensive.

Due to the random-length nature of these planks, packaging the product for sale also increases the expense. These planks are commonly sold at retail to consumers in kits having sufficient random length planks to cover a certain predetermined surface area, such as 50 square feet or 100 square feet. In order to assemble and package such kits, a worker must determine the length of numerous individual planks and attempt to select a combination of these varied panels which yields a surface area as close as possible to the desired square footage. In so choosing a set of panels, the worker may not err on the lower side of the stated square footage or else an individual purchasing that particular set of planks will not receive the quantity of paneling indicated on the packaging.

This selection process is time consuming (thus increasing labor costs), results in bundles to be packaged that have non-uniform configurations (making the packaging process difficult and time consuming), and necessarily requires the continual inclusion in each kit of planks of more wood than is stated on the package.

In order to minimize these difficulties, manufacturers will often cut the planks in nearly random lengths which vary by a preset increment, such as 3" or 6", rather than producing truly random length planks. This does help reduce the time spent in selecting planks to create a kit having the desired surface area and minimizes the excess planking included in each set, but it also significantly increases raw material costs. When producing truly random length planks, the blemishes may be excised from the rough-hewn planks without losing much of the clear, or blemish-free, wood. By cutting the planks to lengths which vary by a preset increment, however, that incremental length must be cut away when removing a visible flaw. For example, if a 6" increment is used, a 6" length of the plank must be cut away to remove a blemish. This obviously leads to the loss of a significant amount of clear wood along with each blemish, greatly increasing the raw material costs of the final planking.

The use of a veneered paneling product is often economically attractive Such veneer paneling utilizes a thin covering of high grade, blemish-free wood. This covering is laminated to a lesser quality wood backer which provides structural support to the veneer. The wood backer may include a larger number of knots or other blemishes since it is not visible after installation. By using only a thin veneer of "clear" wood (i.e., wood which is substantially free of any visible blemishes), the yield of square feet of clear wood per cubic foot of raw lumber used is greatly increased, reducing the raw material costs of the product. Labor costs are also reduced by using a veneer. The veneer paneling is commonly produced mechanically into panels of uniform dimension. This eliminates the time consuming process of selecting individual planks to be combined into a kit having a certain surface area.

However, veneer paneling is often perceived to be of lesser quality than solid wood paneling. A wall or a floor which is covered with solid wood tends to have distinctive appearance due to the random, or nearly random, length planks which make up such a covering. In contrast, when a veneer is used, rather than solid wood, the individual sections comprising the covering typically will all be of a substantially uniform, mechanically produced dimension. Thus, the absence of the individual, random length panels is a telltale sign that the paneling or flooring is not made of a genuine solid hardwood.

Furthermore, certain decorative effects may not readily be achieved by veneers. One popular design for paneling includes beveled edges. When hardwood is used, all four of the edges of the individual planks may be provided with a bevel, which may be on the order of ⅛ inch or more in depth. Since the exterior, clear wood of veneer paneling tends to be quite thin, if one were to attempt to bevel such a veneered panel, the lesser quality wood beneath would be exposed. Thus, the presence of beveling on the edges of planks is another indicator that visually distinguishes solid planking from veneer.

Thus, solid wood paneling comprising a plurality of beveled planks of random lengths is not only visually appealing, but provides an appearance which may not readily be achieved by commonly produced veneer paneling. However, the installation of such hardwood paneling is rather labor intensive, further driving up the ultimate cost of the paneling to consumers. Veneer panels often come in rather large sheets which may readily be applied to a wall to cover large surface areas in a short period of time. When using genuine, solid wood as paneling, though, each of the individual planks must be separately affixed to the wall or the floor being covered. Depending on where the knots or other visible blemishes are located along the length of the rough-hewn planks when cut from the raw lumber, the length of the individual planks being applied as paneling may vary greatly, and some of the planks may be rather short. It takes just as much effort to affix such a short plank to the wall or floor as it does to install a larger plank. Thus, the need to individually apply each and every plank to the surface being covered significantly increases the cost of installing hardwood paneling or flooring. Combined with the labor and raw material costs described above, solid wood paneling or flooring typically can be quite expensive.

SUMMARY OF THE INVENTION

The present invention provides solid wood paneling which is less expensive and easier to install than standard solid wood paneling. Paneling according to the invention is preferably sold in a kit of beveled solid wood planks having a uniform, standardized length. At least some of these panels are made up of shorter, truly random length boards that have been jointed into the longer, uniform length planks. All four edges of each of these individual boards are beveled so that when they are assembled into a plank, the plank will include a bevel which accentuates the location of the joint between the individual boards of a plank.

When such planks are assembled on a wall or floor, this construction provides an appearance which is virtually indistinguishable from the appearance of individual random length solid wood planks. However, as explained below, this construction minimizes labor costs associated with assembling and packaging the planks for sale, reduces the waste of raw material, and reduces the time required to install such paneling.

DESCRIPTION OF THE PREFERRED EMBODIMENT

Figure 1:
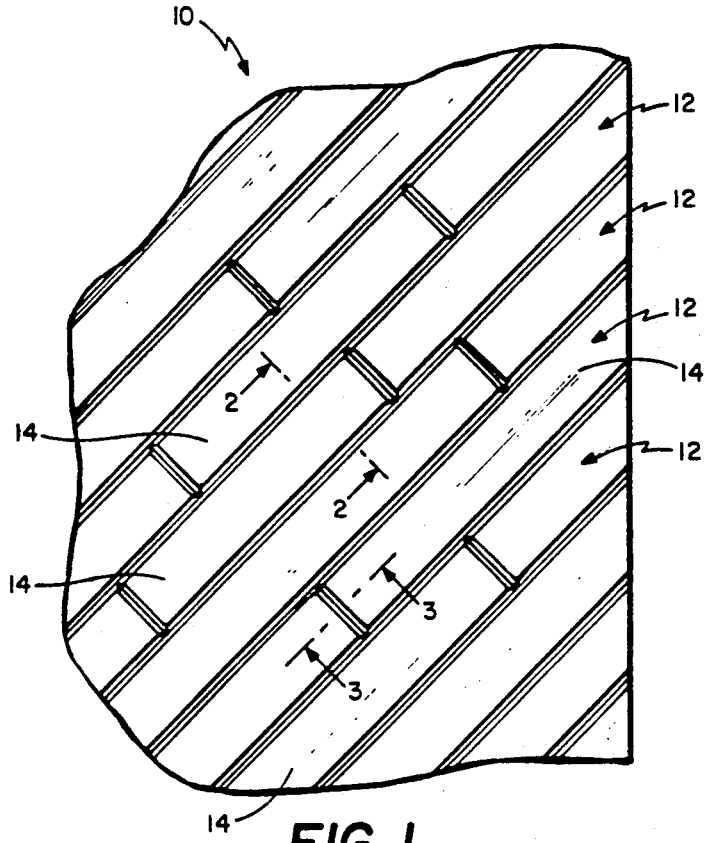
FIG. 1 is an elevational view of a surface covered with paneling according to the present invention.

FIG. 1 depicts solid wood paneling 10 that has been assembled onto a surface such as a wall or floor. The paneling 10 comprises a plurality of planks 12 which are joined to the surface 26 and to one another. This joining of adjacent planks may be accomplished in any manner known in the art, such as by using a glue or like material. In the preferred embodiment shown in FIGS. 2 and 3, though, each of the planks is secured to the adjacent plank by a tongue-and-groove construction. A tongue 20 is provided along one end and one side of each plank while a groove 22 is provided along the other end and other side. The grooves 22 are sized to closely receive the tongues 20 of adjacent planks. Desirably, the tongues substantially fill the grooves, but the fit therebetween is sufficiently loose to allow for deviations due to manufacturing tolerances, normal changes in humidity, and the like.

Figure 2:
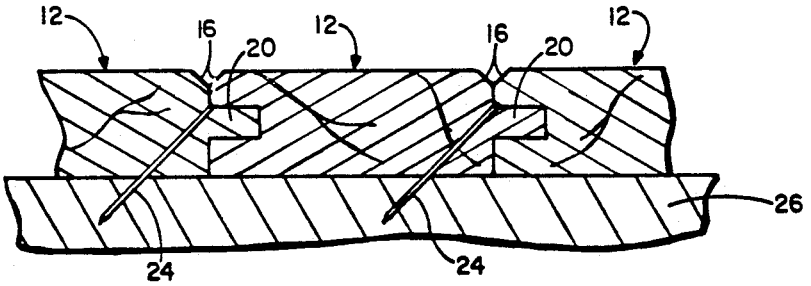
FIG. 2 is a cross-sectional view of the planks of the paneling in FIG. 1 taken along section line 2—2 in FIG. 1.

When covering a wall or other surface 26 with the present paneling, a single plank 12 is commonly laid on the surface at the desired orientation. Most commonly, the planks 12 are applied to the surface being covered in a horizontal or a vertical orientation. However, the planks may be applied to the surface at any desired orientation, such as at a 45° angle with respect to horizontal, as shown in FIG. 1. After the first plank is placed on the surface in the desired orientation, it is affixed to the surface 26. This is desirably accomplished by driving a plurality of nails 24 through the plank and into the surface 26. As shown in FIG. 2, finishing nails may be used and the nail may be driven at an angle through the tongue 20 and a portion of the plank. If finishing nails are used, this will still permit the groove 22 of an adjacent plank to fit over the tongue 20.

After the first plank has been affixed to the surface, a second plank may be added. The groove 22 of this plank may be placed over the tongue 20 of the first plank such that the grooved face 23 of the plank firmly abuts the tongued face 21 of the first plank. By so doing, the finishing nail of the first plank is concealed by the groove of the second plank. The second plank may then be affixed to the surface in the same manner that the first plank was applied. This process may then be repeated until sufficient planks have been affixed to cover the entire surface.

Figure 3:
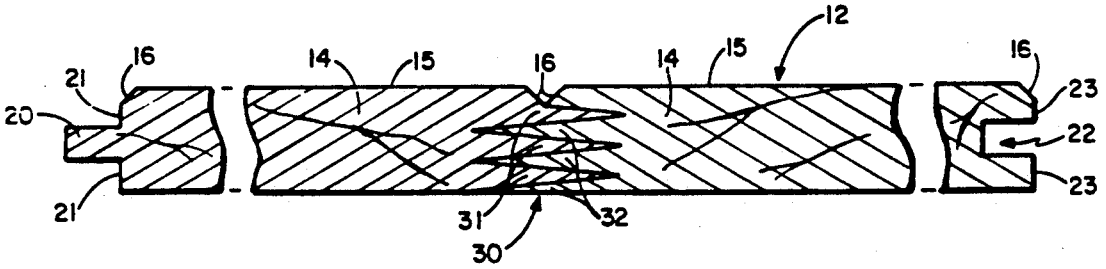
FIG. 3 is a cross-sectional view of a single plank of the paneling shown in FIG. 1 taken along section line 3—3 of FIG. 1.
Figure 4:
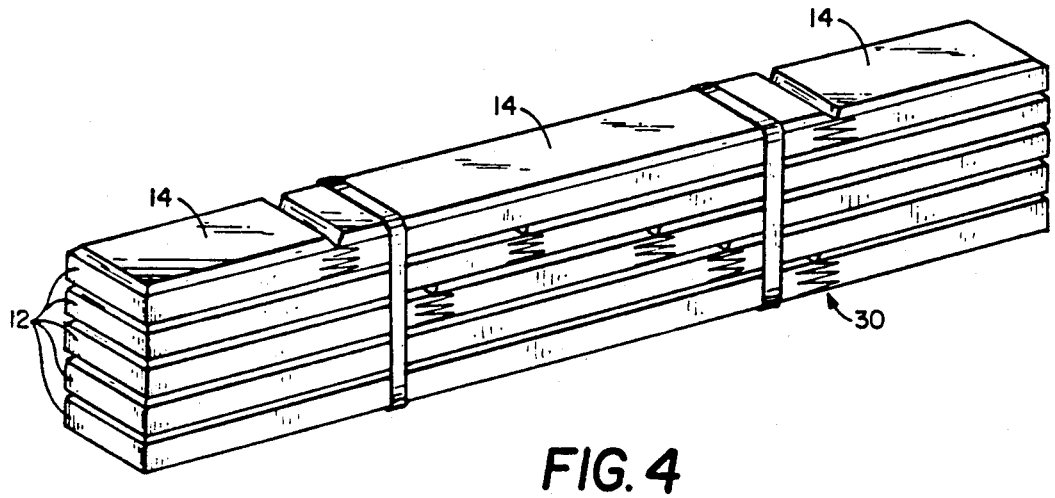
FIG. 4 is a perspective view of a paneling kit of the invention.
Figure 5:
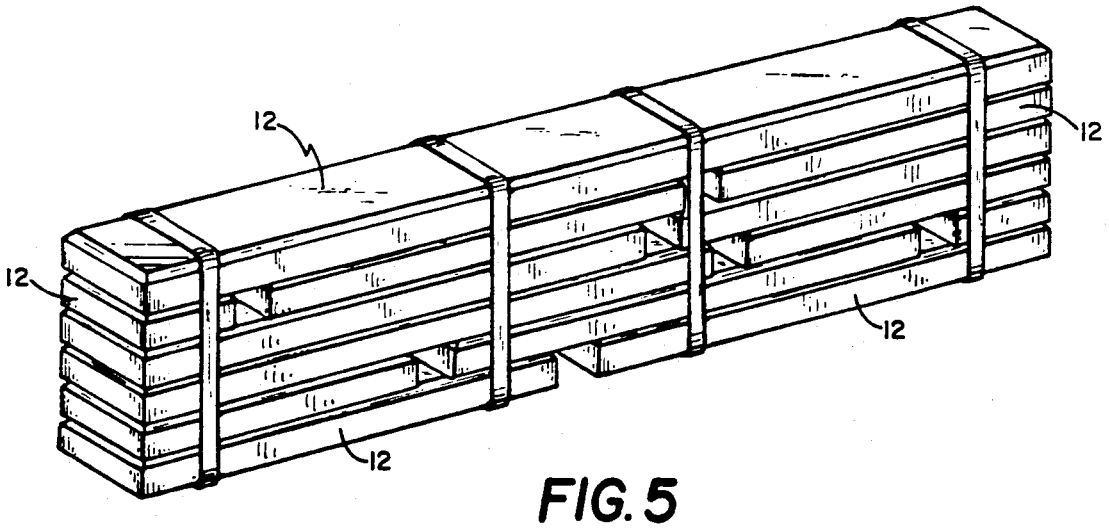
FIG. 5 (PRIOR ART)
FIG. 5 is a perspective view of a prior art kit of panels.

As best illustrated in FIG. 3, at least some of the planks 12 of the present invention are comprised of two or more individual elongate boards 14. These boards 14 are typically of truly random length, such as the boards which are produced when excising blemishes from a long, rough-hewn length of wood, as described above. The boards 14 comprising a plank 12 are joined end-to-end to yield a single, elongated plank 12.

The end of one board may be affixed to the adjacent end of another board by any suitable means. Preferably, though, a finger joint 30 is used. In a preferred embodiment, the blemished wood is cut from the long planks of rough-hewn lumber by a standard saw. This permits the removal of only the blemish, rather than requiring a fixed incremental length of wood, including some clear wood, to be cut away as in the prior art described above. These boards of clear wood may then be provided with a finger joint in a separate manufacturing step by a special set of shaper knives or saws. In forming a finger joint, the ends of two boards are shaped by these knives, which cut the board transversely to provide a plurality of complementary fingers 31,32 which extend across the end of the board. The fingers 31 of a first board are shaped to be received between the fingers 32 of a second board. The surfaces of these fingers are desirably in mating contact. A suitable wood glue or the like is applied to the fingers and the two boards are mated together to form a permanent joint.

In producing the boards of the invention, a beveled edge 16 is also provided adjacent the fingers of each end which is to be finger jointed. This bevel 16 is formed by cutting the board at an acute angle with respect to the visible surface 15 of the board. The beveled ends 16 and fingers 31,32 of adjacent boards are desirably shaped such that the beveled end of one board abuts the lower portion of the bevel of the adjacent mating board, providing a generally V-shaped groove at the joint. If so desired, a similar beveled edge (not shown) may be provided on the end of both faces of the board. In this manner, either side of the board could be used as the visible side.

Planks according to the present invention are constructed to provide kits having all planks of a substantially uniform length. Any length suitable for convenient handling and installation, such as five or eight feet, may be used. The precise length is not as important as the fact that all planks in bundle or kit are of the same length. Each of these uniform planks are formed from boards which may vary substantially in length. It is possible that some boards will be as long as the desired plank length. More commonly, however, most planks will be comprised of two or three (or more) individual boards that have been jointed together to provide a plank of the desired uniform length.

The selection and assembly of boards to be joined together to form each plank may be performed manually. A supply of boards may be delivered to the operator and the operator will assemble any combination of individual random length boards to result in a plank longer than the desired finished length. The plank is then cut off to the desired finished length, and the drop (the cut off end) may be returned to the random length pile of boards to be used again, or may be used immediately to begin assembly of the next plank.

Unlike the process described above wherein a worker must carefully select a number of individual planks to assemble a set having a predetermined surface area, the selection process necessary in forming planks of the invention is very efficient. As the boards are delivered to the operator, he must simply determine whether the first board is of sufficient length to form a plank. If not, he may join as many other boards as needed to exceed the desired finished length, and the excess will be cut off, forming a drop that can be used in subsequent planks. Because it is generally preferred that each of the board sections be of at least a certain minimum length (e.g., typically about 150% of the width of the plank), preferably the operator should select boards to assure that the drop will be at least of that minimum length.

For instance, assuming the desired plank length is five feet and the minimum length of an acceptable board is about six inches, if joining two boards would yield a length of more than about 4'6" but less than about 5'6", the operator should select a board that is slightly longer or slightly shorter. If the combined length of the boards is less than 4'6" in this example. An additional board may be joined to the first two boards to provide the necessary additional length. If the joining of an additional board will result in a length of more than 5'6", the additional length will simply be cut off, yielding the desired 5-foot plank plus a drop which is at least six inches long. The drop may then be used in subsequent planks.

In a preferred embodiment, however, the forming process is continuous rather than requiring an individual to separately form each plank. A plurality of individual boards are joined together as described above to produce a long, continuous plank. This long plank may be of any length greater than a single desired plank, but is generally preferred to be at least twice the desired plank length. It is particularly preferred that the long, uncut plank be formed to provide an integral number of the desired planks. For instance, if a uniform 5-foot long plank is desired, boards can be joined to form a single long plank of 10, 15 or 20 feet. This long plank may then be cut into 2, 3 or 4 individual planks (respectively). The saw cutting the long plank into individual planks is desirably a travelling saw, which is known in the art and need not be discussed further here. Such a saw may be fed with a continuous supply of long planks (or a single, very long plank) and will automatically produce planks of uniform length. This automated process will further reduce labor costs.

The present process produces planks of reproducible and uniform length. These planks may then be easily assembled into sets for uniform packaging, each set having the same number of planks and substantially the exact surface area desired, giving rise to a uniform package size. In comparison, in the prior art, an operator must choose from a large number of planks and attempt to select a combination of planks which will provide at least the designated surface area. Not only is this set building process very time-consuming, but it also leads to wasted material by consistently providing somewhat more surface area than is stated on the preprinted package. Alternatively, if planks are cut to vary by a preset incremental length, the packaging process is simplified, but significant lengths of clear wood are lost in removing each blemish.

As stated above, when an appropriate number of boards has been joined together to provide sufficient length to form a plank, the plank is cut to length. After making this cut, the end of the panel is provided with either a tongue or a groove. The portion of the plank which is cut off will also be provided with a tongue or groove. The assembled plank may then be shaped to provide a beveled edge 16 around its entire periphery and the tongue and groove structure may be formed on the sides of the plank. Alternatively, the sides of the boards may be provided with the beveled edge and a tongue or groove before they are assembled into the plank.

In either manner, the result is a plank which has a beveled edge about its periphery and a beveled edge on adjacent ends of the boards which are joined to form the plank. When a plank of the invention is installed on the surface being covered, its appearance will be virtually indistinguishable from the appearance of beveled solid wood paneling known in the art. Most planks will comprise a number of individual boards which would otherwise have to be individually attached to the surface. Hence, when attaching a single plank of the invention to the surface, the construction process is also facilitated.

A variety of woods may be used in the invention, including oak, birch, and other woods (usually hardwoods) conventionally used in solid wood paneling applications. Similarly, a variety of dimensions may be utilized. As stated above, the invention is particularly suited to paneling that is elongated with the individual random length boards being at least about 150% as long as they are wide. The boards may be of any desired thickness, but should be at least thick enough to permit a structurally sound end-to end joint of adjacent boards in a plank. In a particularly preferred embodiment utilizing either clear or "tight-knot" oak, five and eight foot planks are formed from boards of nominal width of 4" and thickness of ⅜". A 60° bevel is provided on all four edges of one face, the bevels of two adjacent boards forming a groove 0.33 inches wide. The edges have complementary tongues and grooves, and the ends of jointed boards of each plank are finger jointed and include bevels identical to the edges of the plank so that when assembled on a surface the joints of the boards appear to be identical to the joints of the planks. Sets or kits of 10 such 5-foot boards provide a total of 13½ square feet of paneling.

While a preferred embodiment of the present invention has been described, it should be understood that various changes, adaptations and modifications may be made therein without departing from the spirit of the invention and the scope of the appended claims.

What is claimed is:

1. A wood paneling kit comprising a plurality of elongated solid wood planks of generally uniform length and width, each plank having a face, opposing sides, and opposing ends, the sides and ends being beveled adjacent the face; at least some of the planks being comprised of two or more elongated boards each having opposing ends beveled adjacent their respective faces, such boards being structurally joined end-to end so that when the planks are assembled side-to side and end-to-end, the joints between boards of a plank have generally the same appearance as the joints between adjacent planks said elongated boards being substantially the same in width however non-uniform in length.

2. The kit of claim 1 wherein the boards of a plank are joined to adjacent boards of the plank by a finger joint.

3. The kit of claim 1 wherein the planks are at least about three feet in length, between about one inch and eight inches in width, and from about ⅛ inch to about one inch in thickness.

4. The kit of claim 1 wherein the bevel is at an angle of between about 10° and about 80° from the face of the plank.

5. The kit of claim 1 wherein the bevel extends inwardly from the face of the plank to a depth of about 1/6 to about ½ of the thickness of the plank.

6. The kit of claim 1 wherein the individual boards of each plank have a length at least about 150% of their width.

* * * * *